US010798483B2

(12) United States Patent
Li et al.

(10) Patent No.: US 10,798,483 B2
(45) Date of Patent: Oct. 6, 2020

(54) AUDIO SIGNAL PROCESSING METHOD AND DEVICE, ELECTRONIC EQUIPMENT AND STORAGE MEDIUM

(71) Applicant: BEIJING XIAOMI MOBILE SOFTWARE CO., LTD., Beijing (CN)

(72) Inventors: Jiongliang Li, Beijing (CN); Si Cheng, Beijing (CN)

(73) Assignee: BEIJING XIAOMI MOBILE SOFTWARE CO., LTD., Beijing (CN)

( * ) Notice: Subject to any disclaimer, the term of this patent is extended or adjusted under 35 U.S.C. 154(b) by 0 days.

(21) Appl. No.: 16/425,111

(22) Filed: May 29, 2019

(65) Prior Publication Data

US 2019/0373364 A1 Dec. 5, 2019

(30) Foreign Application Priority Data

May 30, 2018 (CN) ..... 2018 1 0536912

(51) Int. Cl.
*H04R 3/00* (2006.01)
*G10L 21/0232* (2013.01)
(Continued)

(52) U.S. Cl.
CPC ..... *H04R 3/005* (2013.01); *G10L 21/0232* (2013.01); *G10L 25/18* (2013.01); *H04R 1/406* (2013.01)

(58) Field of Classification Search
CPC .. H04R 3/005; H04R 1/406; H04R 2201/401; H04R 2201/403; H04R 25/407;
(Continued)

(56) References Cited

U.S. PATENT DOCUMENTS 9,955,277 B1 4/2018 Alexandridis et al.
2012/0303363 A1 11/2012 Sorensen
(Continued)

FOREIGN PATENT DOCUMENTS

CN 102305925 A 1/2012
CN 106205628 A 12/2016
(Continued)

OTHER PUBLICATIONS

Extended European Search Report dated Oct. 31, 2019 in Patent Application No. 19177111.2, 8 pages.
(Continued)

*Primary Examiner* — Ahmad F. Matar
*Assistant Examiner* — Sabrina Diaz
(74) *Attorney, Agent, or Firm* — Oblon, McClelland, Maier & Neustadt, L.L.P.

(57) ABSTRACT

The disclosure relates to an audio signal processing method, device, and computer-readable medium. The method is applied to an electronic equipment that includes multiple audio acquisition devices with distances between the multiple audio acquisition devices meeting a preset distance condition. The method includes acquiring an audio signal acquired by each of the audio acquisition devices; determining a position of a target sound source sending the audio signal relative to the multiple audio acquisition devices based on the audio signal acquired by each of the audio acquisition devices; determining a target signal optimization algorithm corresponding to the position of the target sound source relative to the multiple audio acquisition devices based on pre-stored correspondences between directions and signal optimization algorithms; inputting the audio signal acquired by each of the audio acquisition devices into the determined target signal optimization algorithm; and obtain-
(Continued)

ing an optimized audio signal based on the determined target signal optimization algorithm.

12 Claims, 8 Drawing Sheets

(51) Int. Cl.
*G10L 25/18* (2013.01)
*H04R 1/40* (2006.01)

(58) Field of Classification Search
CPC ..... H04R 2410/07; H04R 2410/01; G10L 21/0232; G10L 21/0208; G10L 25/18; G10L 2021/02165; G11B 20/24
USPC ..... 381/92, 94.1
See application file for complete search history.

(56) References Cited

U.S. PATENT DOCUMENTS

2013/0121498 A1* 5/2013 Giesbrecht ..... H04M 9/082 381/66
2013/0294608 A1 11/2013 Yoo et al.
2014/0153742 A1* 6/2014 Hershey ..... H04B 15/00 381/94.1
2016/0073198 A1 3/2016 Vilermo et al.
2017/0125037 A1 5/2017 Shin

FOREIGN PATENT DOCUMENTS

CN 106653041 A 5/2017
CN 106782584 A 5/2017
CN 106898360 A 6/2017
CN 206349145 U 7/2017
CN 107026934 A 8/2017
CN 107271963 A 10/2017
CN 107993671 A 5/2018
CN 108028982 A 5/2018

OTHER PUBLICATIONS

Combined Chinese Office Action and Search Report dated Mar. 12, 2020 in corresponding Chinese Patent Application No. 201810536912.9, (with English Translation), 20 pages.
Jia Yin-jie et al., "Blind Separation of Mixed Audio Signal Based on FastICA", Information and Electronic Engineering, vol. 7, No. 4, Aug. 31, 2009, pp. 321-325 (with English Abstract).
Chen, Xiaoyan, "Research on Robust Microphone Array Beamforming Speech Enhancement Algorithm in Reverberantation Environments", China Excellent Master thesis Full-text Database Information Technology Series, issued on Mar. 15, 2018, entire document (with English Abstract).

* cited by examiner

AUDIO SIGNAL PROCESSING METHOD AND DEVICE, ELECTRONIC EQUIPMENT AND STORAGE MEDIUM

CROSS-REFERENCE TO RELATED APPLICATIONS

This application is based upon and claims priority to Chinese Patent Application No. 201810536912.9, filed on May 30, 2018, the entire contents of which are incorporated herein by reference.

TECHNICAL FIELD

The present disclosure generally relates to the field of audio techniques, and particularly to an audio signal processing method and device, electronic equipment and a storage medium.

BACKGROUND

In a complex acoustic environment, an audio acquisition device may inevitably acquire, in an audio signal pickup process, an interference signal such as a room reverb, a noise and a voice of another user, thereby having an effect on a quality of a picked-up audio signal.

To reduce the effect of the interference signal on the audio signal, it is necessary to perform noise suppression on the audio signal picked up by the audio acquisition device. Electronic equipment may adopt the same noise suppression technique for acquired audio signals, which results in a poor noise suppression effect.

SUMMARY

This Summary is provided to introduce a selection of aspects of the present disclosure in a simplified form that are further described below in the Detailed Description. This Summary is not intended to identify key features or essential features of the claimed subject matter, nor is it intended to be used to limit the scope of the claimed subject matter.

Aspects of the disclosure provide an audio signal processing method, applied to an electronic equipment that includes multiple audio acquisition devices with distances between the multiple audio acquisition devices meeting a preset distance condition. The method includes acquiring an audio signal acquired by each of the audio acquisition devices; determining a position of a target sound source sending the audio signal relative to the multiple audio acquisition devices based on the audio signal acquired by each of the audio acquisition devices; determining a target signal optimization algorithm corresponding to the position of the target sound source relative to the multiple audio acquisition devices based on pre-stored correspondences between directions and signal optimization algorithms; inputting the audio signal acquired by each of the audio acquisition devices into the determined target signal optimization algorithm; and obtaining an optimized audio signal based on the determined target signal optimization algorithm.

According to an aspect, when determining the position of the target sound source, the method further includes converting the audio signal acquired by each of the audio acquisition devices into a corresponding frequency-domain signal; performing cross-correlation spectrum calculation on each of the frequency-domain signals to obtain differences in acquisition time of respective audio signals by different audio acquisition devices; and determining the position of the target sound source sending the audio signal relative to the multiple audio acquisition devices based on the differences in acquisition time of respective audio signals by different audio acquisition devices and the distances between the multiple audio acquisition devices.

In an example, the number of the audio acquisition devices is two, a distance between the two audio acquisition devices is equal to a preset distance value, and the two audio acquisition devices are arranged on a same sidewall of the electronic equipment.

According to an aspect, when determining the target signal optimization algorithm, the method further includes determining an included angle between a connecting line of the target sound source and a midpoint of the two audio acquisition devices and a target ray, wherein the target ray is a ray perpendicular to the sidewall at the midpoint and pointing to an outer side of the sidewall; and determining the target signal optimization algorithm corresponding to the included angle between the connecting line and the target ray based on pre-stored correspondences between included angles and signal optimization algorithms.

According to another aspect, when determining the target signal optimization algorithm, the method further includes, when the included angle is less than a preset threshold value, determining that the target signal optimization algorithm is a Chebyshev algorithm; and when the included angle is greater than the preset threshold value, determining that the target signal optimization algorithm is a differential array algorithm.

In an example, both of the two audio acquisition devices face an outer side of the sidewall.

Aspects of the disclosure also provide an audio signal processing device, applied to an electronic equipment that includes multiple audio acquisition devices with distances between the multiple audio acquisition devices meeting a preset distance condition. The device comprises a processor and a memory configured to store instructions executable by the processor. The processor is configured to acquire an audio signal acquired by each of the audio acquisition devices; determine a position of a target sound source sending the audio signal relative to the multiple audio acquisition devices based on the audio signal acquired by each of the audio acquisition devices; determine a target signal optimization algorithm corresponding to the position of the target sound source relative to the multiple audio acquisition devices based on pre-stored correspondences between directions and signal optimization algorithms; input the audio signal acquired by each of the audio acquisition devices into the determined target signal optimization algorithm; and obtain an optimized audio signal based on the determined target signal optimization algorithm.

Aspects of the disclosure also provide a non-transitory computer-readable storage medium having stored therein instructions that, when executed by one or more processors of an electronic equipment including multiple audio acquisition devices with distances between the multiple audio acquisition devices meeting a preset distance condition, cause the one or more processors to acquire an audio signal acquired by each of the audio acquisition devices; determine a position of a target sound source sending the audio signal relative to the multiple audio acquisition devices based on the audio signal acquired by each of the audio acquisition devices; determine a target signal optimization algorithm corresponding to the position of the target sound source relative to the multiple audio acquisition devices based on pre-stored correspondences between directions and signal optimization algorithms; input the audio signal acquired by each of the audio acquisition devices into the determined target signal optimization algorithm; and obtain an optimized audio signal based on the determined target signal optimization algorithm.

It is to be understood that both the foregoing general description and the following detailed description are illustrative and explanatory only and are not restrictive of the present disclosure.

BRIEF DESCRIPTION OF THE DRAWINGS

The accompanying drawings, which are incorporated in and constitute a part of this specification, illustrate aspects consistent with the present disclosure and, together with the description, serve to explain the principles of the present disclosure.

The specific aspects of the present disclosure, which have been illustrated by the accompanying drawings described above, will be described in detail below. These accompanying drawings and description are not intended to limit the scope of the present disclosure in any manner, but to explain the concept of the present disclosure to those skilled in the art via referencing specific aspects.

DETAILED DESCRIPTION

Reference will now be made in detail to exemplary aspects, examples of which are illustrated in the accompanying drawings. The following description refers to the accompanying drawings in which the same numbers in different drawings represent the same or similar elements unless otherwise represented. The implementations set forth in the following description of illustrative aspects do not represent all implementations consistent with the disclosure. Instead, they are merely examples of apparatuses and methods consistent with aspects related to the disclosure as recited in the appended claims.

"First", "second" and similar terms mentioned in the present disclosure are adopted not to represent any sequence, number or importance but only to distinguish different parts. Similarly, similar terms such as "one" or "a/an" also do not represent a number limit but only represent existence of at least one. Similar terms such as "connect" or "interconnect" are not limited to physical or mechanical connection but may include electrical connection, either direct or indirect.

"Module" mentioned in the present disclosure usually refers to a program or instruction capable of realizing some functions in a memory. "Unit" mentioned in the present disclosure usually refers to a functional structure divided according to a logic. The "unit" may be implemented completely by hardware or implemented by a combination of software and hardware.

"Multiple" mentioned in the present disclosure refers to two or more than two. "And/or" describes an association relationship of associated objects and represent that three relationships may exist. For example, A and/or B may represent three conditions, i.e., independent existence of A, coexistence of A and B and independent existence of B. Character "/" usually represents that previous and next associated objects form an "or" relationship.

For making the purposes, technical solutions and advantages of the present disclosure clearer, implementation modes of the present disclosure will further be described below in combination with the accompanying drawings in detail.

First Aspect

Figure 1:
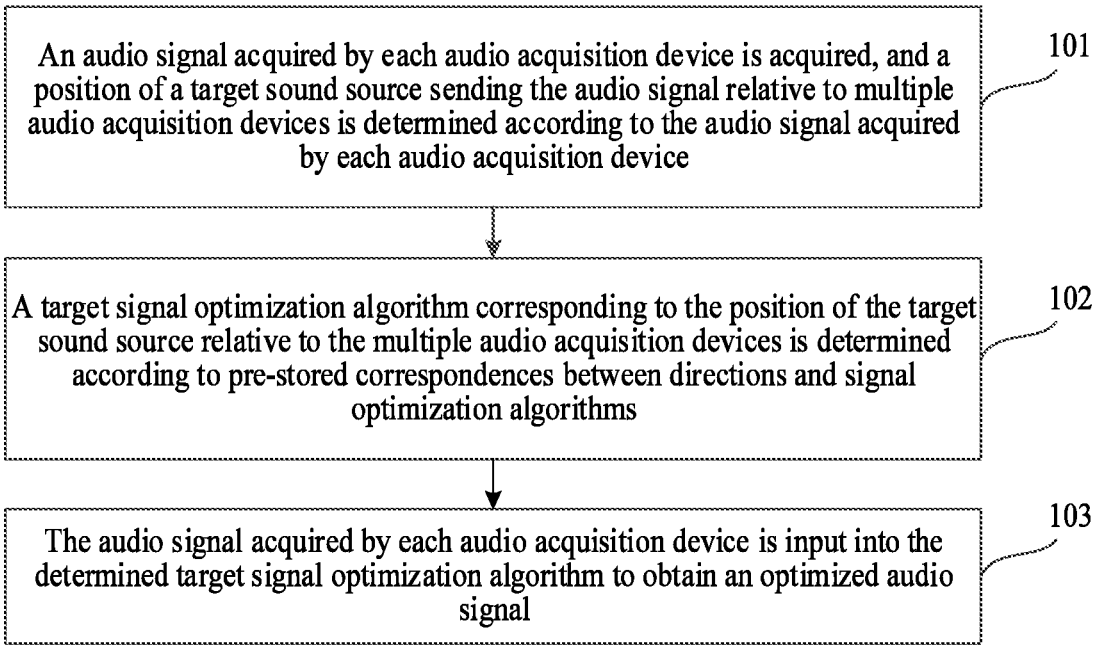
FIG. 1 is a method flow chart showing an audio signal processing method, according to an exemplary aspect of the present disclosure.

FIG. 1 is a method flow chart showing an audio signal processing method, according to an exemplary aspect. As shown in FIG. 1, the audio signal processing method includes the following steps.

In Step 101, an audio signal acquired by each audio acquisition device is acquired, and a position of a target sound source sending the audio signal relative to the multiple audio acquisition devices is determined according to the audio signal acquired by each audio acquisition device.

In Step 102, a target signal optimization algorithm corresponding to the position of the target sound source relative to the multiple audio acquisition devices is determined according to pre-stored correspondences between directions and signal optimization algorithms.

In Step 103, the audio signal acquired by each audio acquisition device is input into the determined target signal optimization algorithm to obtain an optimized audio signal.

From the above, according to the audio signal processing method provided in the aspect of the present disclosure, the sound source position of the target sound source is determined to obtain the signal optimization algorithm corresponding to the sound source direction, then signal optimization is performed on the audio signal of the target sound source. Since a terminal determines the signal optimization algorithm corresponding to the target sound source according to the sound source direction, it is possible to solve the problem of poor noise suppression effect caused by the fact that electronic equipment adopts the same noise suppression manner for acquired audio signals in the conventional art, and an effect of improving the noise suppression effect is achieved.

Second Aspect

The number of audio acquisition devices involved in a target sound source determination method involved in the aspect is at least 3 and all the audio acquisition devices are located on the same plane.

Figure 2A:
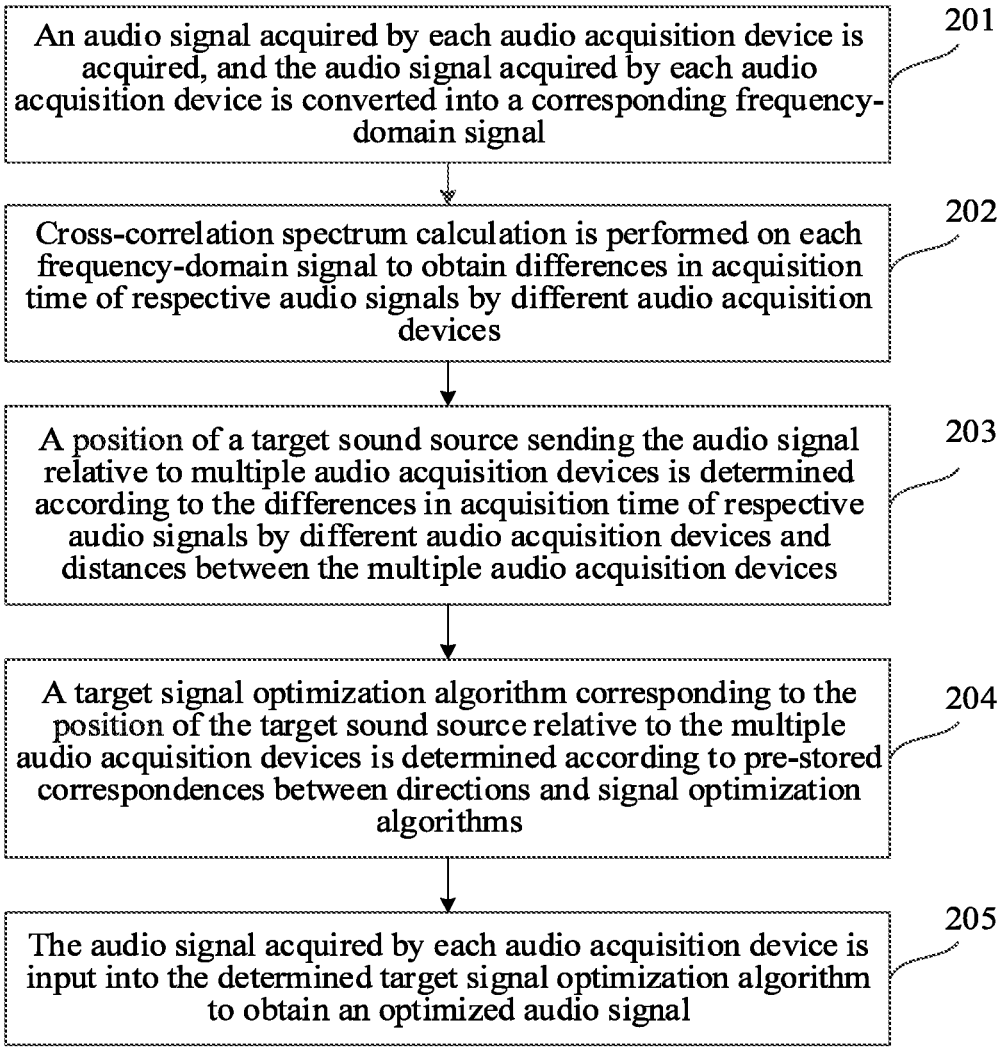
FIG. 2A is a method flow chart showing an audio signal processing method, according to another exemplary aspect of the present disclosure.

FIG. 2A is a method flow chart showing an audio signal processing method, according to another exemplary aspect. As shown in FIG. 2A, the audio signal processing method includes the following steps.

In Step 201, an audio signal acquired by each audio acquisition device is acquired, and the audio signal acquired by each audio acquisition device is converted into a corresponding frequency-domain signal.

The audio signals acquired by the audio acquisition devices are time-domain signals. A processor unit, after receiving the audio signal acquired by each audio acquisition device, is required to convert the time-domain signals into the frequency-domain signals by use of a discrete Fast Fourier Transformation (FFT) algorithm.

In Step 202, cross-correlation spectrum calculation is performed on each frequency-domain signal to obtain differences in acquisition time of respective audio signals by different audio acquisition devices.

The processor unit performs cross-correlation spectrum calculation on each frequency-domain signal obtained by conversion to obtain the differences in time $(t_2-t_1)$ to $(t_n-t_1)$ between moments when the second audio acquisition device to the nth audio acquisition device acquire an audio signal from a target sound source S and moments when the first audio acquisition device acquires the audio signal from the target sound source S, respectively.

In Step 203, a position of a target sound source sending the audio signal relative to multiple audio acquisition devices is determined according to the differences in acquisition time of respective audio signals by different audio acquisition devices and distances between the multiple audio acquisition devices.

Figure 2B:
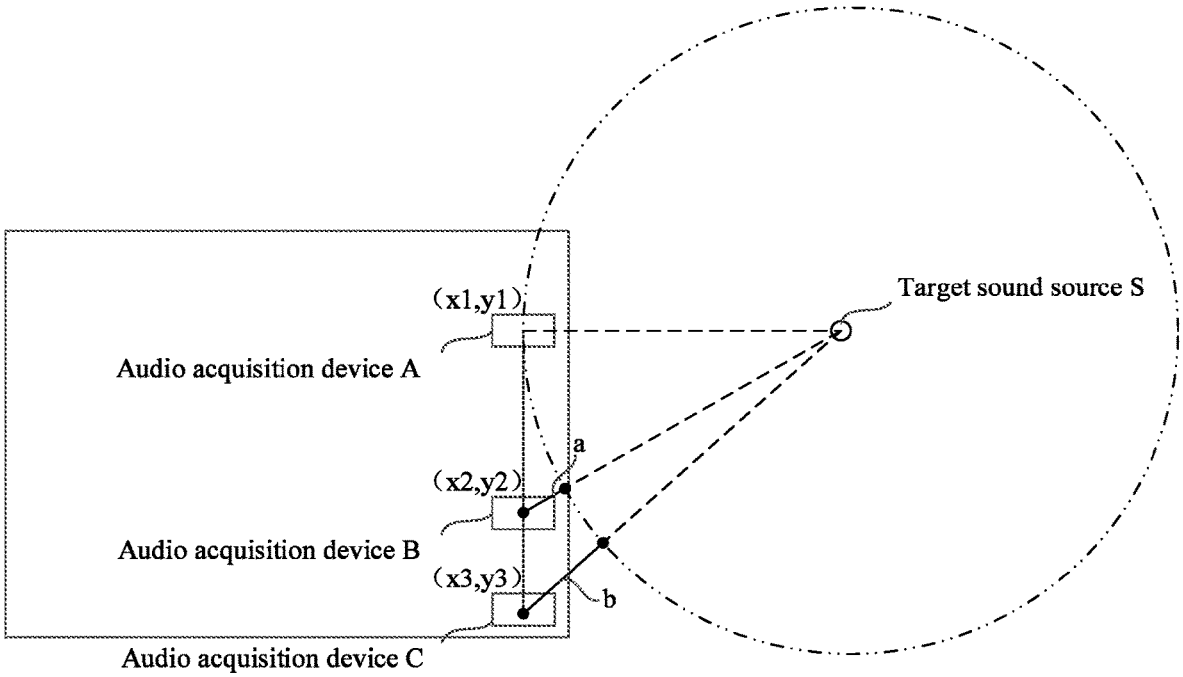
FIG. 2B is a schematic diagram illustrating positions between a target sound source and audio acquisition devices, according to an exemplary aspect of the present disclosure.

FIG. 2B is a schematic diagram illustrating positions between a target sound source and audio acquisition devices, according to an exemplary aspect. As shown in FIG. 2B, for example, coordinates of the target sound source S, an audio acquisition device A, an audio acquisition device B and an audio acquisition device C are $(x_s, y_s)$, $(x_1, y_1)$, $(x_2, y_2)$ and $(x_3, y_3)$ respectively, and the coordinates may be substituted into a distance formula to obtain distances $\sqrt{(x_s-x_1)^2-(y_s-y_1)^2}$, $\sqrt{(x_s-x_2)^2-(y_s-y_2)^2}$ and $\sqrt{(x_s-x_3)^2-(y_s-y_3)^2}$ from the audio acquisition device A, the audio acquisition device B and the audio acquisition device C to the target sound source S respectively. A difference 'a' between the distances from the audio acquisition device B and the audio acquisition device A to the target sound source S is $\sqrt{(x_s-x_2)^2-(y_s-y_2)^2}-\sqrt{(x_s-x_1)^2-(y_s-y_1)^2}$, and a difference 'b' between distances from the audio acquisition device C and the audio acquisition device A to the target sound source S is $\sqrt{(x_s-x_3)^2-(y_s-y_3)^2}-\sqrt{(x_s-x_1)^2-(y_s-y_1)^2}$. Since the difference 'a' between the distances from the audio acquisition device B and the audio acquisition device A to the target sound source S is equal to $c(t_2-t_1)$ and the difference 'b' between the distances from the audio acquisition device C and the audio acquisition device A to the target sound source S is equal to $c(t_3-t_1)$, simultaneous equations (1) and (2) are obtained:

$$\begin{cases} \sqrt{(x_s-x_2)^2-(y_s-y_2)^2}-\sqrt{(x_s-x_1)^2-(y_s-y_1)^2}=c(t_2-t_1) & (1) \\ \sqrt{(x_s-x_3)^2-(y_s-y_3)^2}-\sqrt{(x_s-x_1)^2-(y_s-y_1)^2}=c(t_3-t_1) & (2) \end{cases}$$

Since all of the coordinate $(x_1, y_1)$ of the audio acquisition device A, the coordinate $(x_2, y_2)$ of the audio acquisition device B, the coordinate $(x_3, y_3)$ of the audio acquisition device C, a sound velocity c, the difference in time $(t_2-t_1)$ and the difference in time $(t_3-t_1)$ are known, the simultaneous equations (1) and (2) may be solved to calculate the coordinate $(x_s, y_s)$ of the target sound source S.

In Step 204, a target signal optimization algorithm corresponding to the position of the target sound source relative to the multiple audio acquisition devices is determined according to pre-stored correspondences between directions and signal optimization algorithms.

Wherein, the signal optimization algorithms include, but not limited to, a Chebyshev algorithm and a differential array algorithm.

In Step 205, the audio signal acquired by each audio acquisition device is input into the determined target signal optimization algorithm to obtain an optimized audio signal.

For example, for the Chebyshev algorithm, after the position of the target sound source relative to the multiple audio acquisition devices is determined, the direction is taken as an expected main beam lobe direction angle, and the audio signals of the expected main beam lobe direction angle are weighted by Chebyshev to reduce side lobes.

From the above, according to the audio signal processing method provided in the aspect of the present disclosure, the sound source position of the target sound source is determined to obtain the signal optimization algorithm corresponding to the sound source direction, then signal optimization is performed on the audio signal of the target sound source. Since a terminal determines the signal optimization algorithm corresponding to the target sound source according to the sound source direction, it is possible to solve the problem of poor noise suppression effect caused by the fact that electronic equipment adopts the same noise suppression manner for acquired audio signals in the conventional art, and an effect of improving the noise suppression effect is achieved.

Third Aspect

In the aspect, the number of audio acquisition devices acquiring audio signals is 2, a distance between the two audio acquisition devices is equal to a preset distance value (preferably, a value range of the preset distance value is 6 cm~7 cm), and the two audio acquisition devices are arranged on the same sidewall of electronic equipment. Optionally, orientations of the two audio acquisition devices are the same and both of them face an outer side of the sidewall.

Figure 3A:
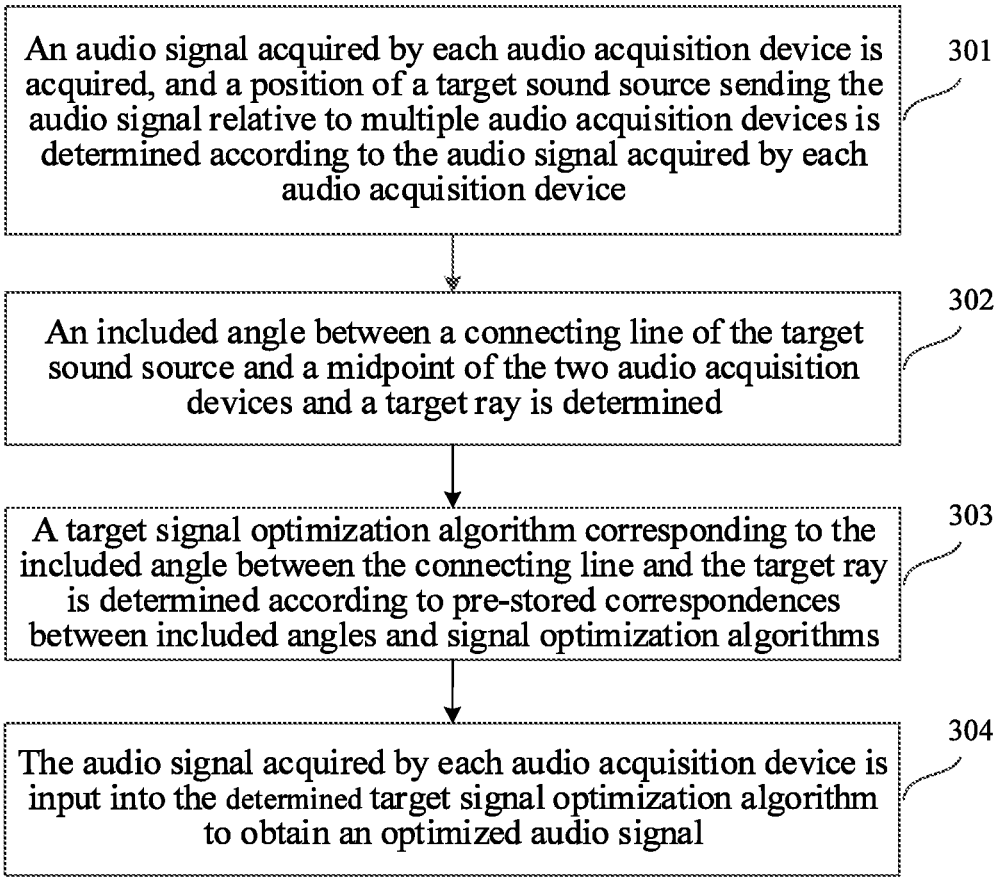
FIG. 3A is a method flow chart showing an audio signal processing method, according to another exemplary aspect of the present disclosure.

FIG. 3A is a method flow chart showing an audio signal processing method, according to another exemplary aspect. As shown in FIG. 3A, the audio signal processing method includes the following steps.

In Step 301, an audio signal acquired by each audio acquisition device is acquired, and a position of a target sound source sending the audio signal relative to multiple audio acquisition devices is determined according to the audio signal acquired by each audio acquisition device.

In Step 302, an included angle between a connecting line of the target sound source and a midpoint of the two audio acquisition devices and a target ray is determined.

Wherein, the target ray is a ray perpendicular to the sidewall at the midpoint and pointing to the outer side of the sidewall.

Figure 3B:
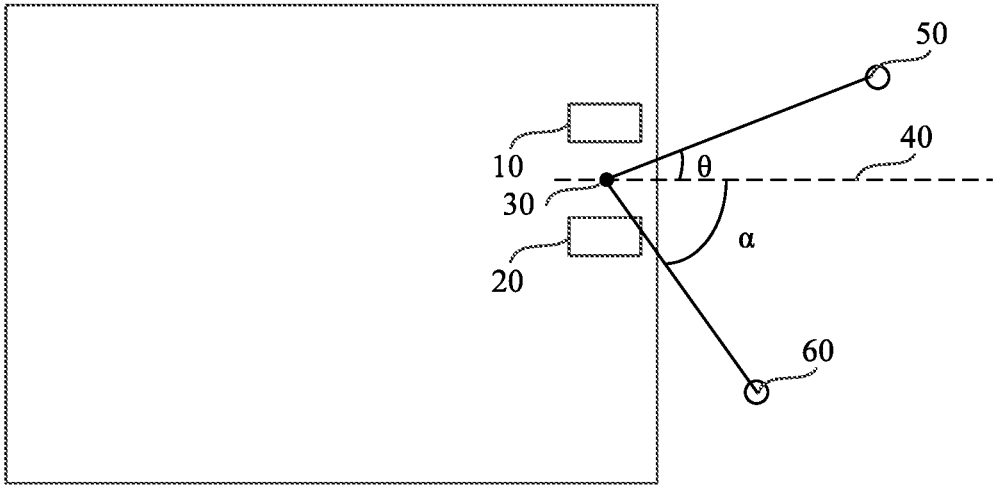
FIG. 3B is a schematic diagram illustrating positions between a target sound source and audio acquisition devices, according to another exemplary aspect of the present disclosure.

FIG. 3B is a schematic diagram illustrating positions between a target sound source and audio acquisition devices, according to another exemplary aspect. As shown in FIG. 3B, an included angle between a connecting line of a target sound source 50 and a midpoint 30 of an audio acquisition device 10 and an audio acquisition device 20 and a target ray 40 is θ. An included angle between a connecting line of a target sound source 60 and the midpoint 30 of the audio acquisition device 10 and the audio acquisition device 20 and the target ray 40 is $\alpha$.

In Step 303, a target signal optimization algorithm corresponding to the included angle between the connecting line and the target ray is determined according to pre-stored correspondences between included angles and signal optimization algorithms.

In a possible implementation mode, the signal optimization algorithms in the correspondences include a Chebyshev algorithm and a differential array algorithm.

In S1, when the included angle is smaller than a preset threshold value, it is determined that the target signal optimization algorithm is a Chebyshev algorithm.

When the included angle between the connecting line and the target ray is smaller than the preset threshold value, a difference in reception time of the audio signals by the two audio acquisition devices is relatively great, and adopting the Chebyshev algorithm may implement side lobe suppression well.

Figure 3C:
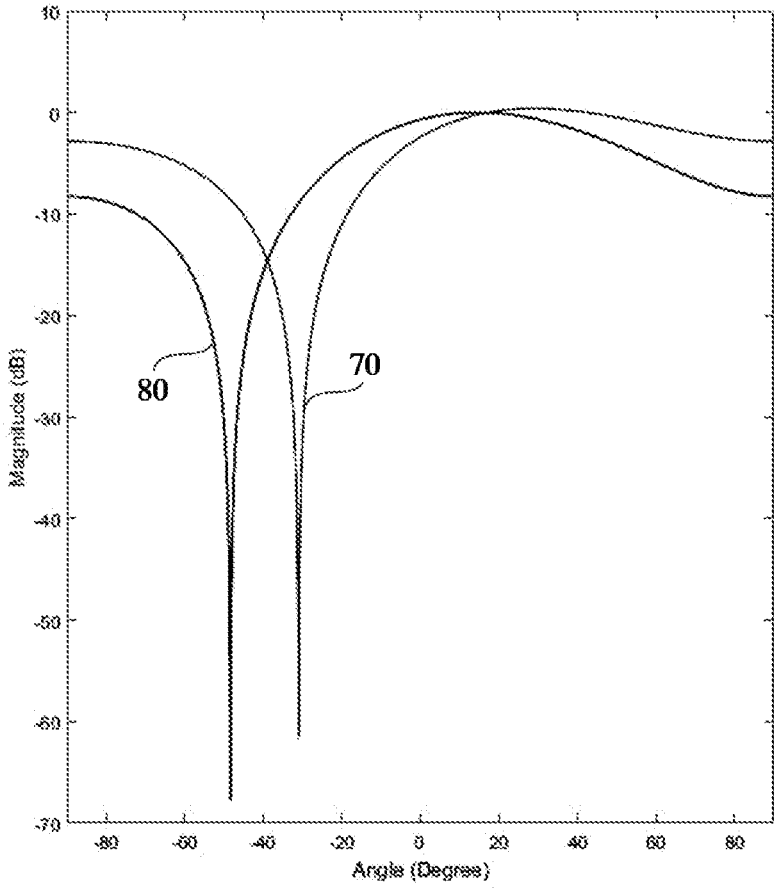
FIG. 3C is a comparison diagram of beams obtained by performing audio signal processing through a Minimum Variance Distortionless Response (MVDR) technology and a Chebyshev algorithm respectively, according to an exemplary aspect of the present disclosure.

FIG. 3C is a comparison diagram of beams obtained by performing audio signal processing through an MVDR technology and a Chebyshev algorithm respectively, according to an exemplary aspect. As shown in FIG. 3C, for example, an expected main beam lobe direction angle is a 30-degree direction, a line 70 is a beam obtained by performing audio signal processing through a conventional MVDR technology, and a line 80 is a beam obtained by performing audio signal processing through the Chebyshev algorithm. From comparison between the line 70 and the line 80, it can be seen that, under the condition of ensuring no obvious attenuation in a 20-degree direction, a better side lobe suppression effect is achieved for the beam obtained by performing audio signal processing through the Chebyshev algorithm.

In S2, when the included angle is larger than the preset threshold value, it is determined that the target signal optimization algorithm is a differential array algorithm.

When the included angle between the connecting line and the target ray is larger than the preset threshold value, the difference in reception time of the audio signals by the two audio acquisition devices is relatively great, and adopting the differential array algorithm may implement noise suppression well.

It is to be noted that a specific numerical value and setting manner of the preset threshold value are not limited in the aspect. Preferably, the preset threshold value is 60 degrees.

In Step 304, the audio signal acquired by each audio acquisition device is input into the determined target signal optimization algorithm to obtain an optimized audio signal.

It is to be noted that Step 304 in the aspect is similar to Step 205 and thus Step 304 will not be elaborated in the aspect.

From the above, according to the audio signal processing method provided in the aspect of the present disclosure, the sound source position of the target sound source is determined to obtain the signal optimization algorithm corresponding to the sound source direction, then signal optimization on the audio signal of the target sound source. Since a terminal determines the signal optimization algorithm corresponding to the target sound source according to the sound source direction, it is possible to solve the problem of poor noise suppression effect caused by the fact that the electronic equipment adopts the same noise suppression manner for acquired audio signals in the conventional art, and an effect of improving the noise suppression effect is achieved.

In the aspect, when the distance between the two audio acquisition devices is 6 cm~7 cm and the two audio acquisition devices are arranged on the same sidewall of the electronic equipment, a pickup distance of the electronic equipment may reach 3.5 meters and a pickup angle of the electronic equipment is enlarged into 360°, i.e., all directions, so that a pickup capability of the electronic equipment is improved.

It is to be noted that state names and message names mentioned in each abovementioned aspect are all schematic and the state names and message names mentioned in the aspects are not limited in the aspect. All states or messages with the same state characteristics or the same message functions shall fall within the scope of protection of the present disclosure.

The below is a device aspect of the present disclosure and may be arranged to execute the method aspect of the present disclosure. Details undisclosed in the device aspect of the present disclosure refer to the method aspect of the present disclosure.

Figure 4:
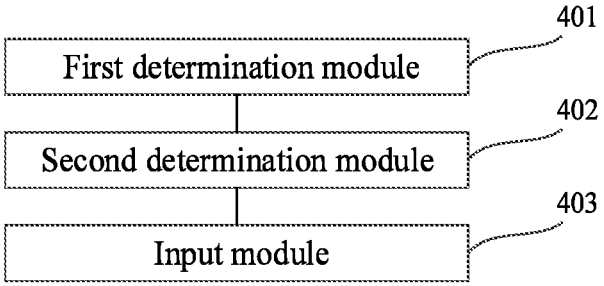
FIG. 4 is a block diagram of an audio signal processing device, according to an exemplary aspect of the present disclosure.

FIG. 4 is a block diagram of an audio signal processing device, according to an exemplary aspect. As shown in FIG. 4, the audio signal processing device is applied to electronic equipment in an implementation environment shown in FIG. 1, and the audio signal processing device includes, but not limited to, a first determination module 401, a second determination module 402 and an input module 403.

The first determination module 401 is arranged to acquire an audio signal acquired by each audio acquisition device and determine a position of a target sound source sending the audio signal relative to multiple audio acquisition devices according to the audio signal acquired by each audio acquisition device.

The second determination module 402 is arranged to determine a target signal optimization algorithm corresponding to the position of the target sound source relative to the multiple audio acquisition devices according to pre-stored correspondences between directions and signal optimization algorithms.

The input module 403 is arranged to input the audio signal acquired by each audio acquisition device into the determined target signal optimization algorithm to obtain an optimized audio signal.

Optionally, the first determination module 401 includes:

a conversion unit arranged to convert the audio signal acquired by each audio acquisition device into a corresponding frequency-domain signal;

a calculation unit arranged to perform cross-correlation spectrum calculation on each frequency-domain signal to obtain differences in acquisition time of respective audio signals by different audio acquisition devices; and a first determination unit arranged to determine the position of the target sound source sending the audio signal relative to the multiple audio acquisition devices according to the differences in acquisition time of respective audio signals by different audio acquisition devices and the distances between the multiple audio acquisition devices.

Optionally, the number of the audio acquisition devices is 2, a distance between the two audio acquisition devices is equal to a preset distance value, and the two audio acquisition devices are arranged on the same sidewall of the electronic equipment.

Optionally, the first determination module 402 further includes:

a second determination unit arranged to determine an included angle between a connecting line of the target sound source and a midpoint of the two audio acquisition devices and a target ray, wherein the target ray is a ray perpendicular to the sidewall at the midpoint and pointing to an outer side of the sidewall; and a third determination unit arranged to determine a target signal optimization algorithm corresponding to the included angle between the connecting line and the target ray according to pre-stored correspondences between included angles and signal optimization algorithms.

Optionally, the third determination unit includes:

a first determination subunit arranged to, when the included angle is smaller than a preset threshold value, determine that the target signal optimization algorithm is a Chebyshev algorithm; and a second determination subunit arranged to, when the included angle is larger than a preset threshold value, determine that the target signal optimization algorithm is a differential array algorithm.

Optionally, orientations of the two audio acquisition devices are the same and both of them face the outer side of the sidewall.

From the above, according to the audio signal processing device provided in the aspect of the present disclosure, the sound source position of the target sound source is determined to obtain the signal optimization algorithm corresponding to the sound source direction, signal optimization is performed on the audio signal of the target sound source. Since a terminal determines the signal optimization algorithm corresponding to the target sound source according to the sound source direction, it is possible to solve the problem of poor noise suppression effect caused by the fact that the electronic equipment adopts the same noise suppression manner for acquired audio signals in the conventional art, and an effect of improving the noise suppression effect is achieved.

In the aspect, when the distance between the two audio acquisition devices is 6 cm~7 cm and the two audio acquisition devices are arranged on the same sidewall of the electronic equipment, a pickup distance of the electronic equipment may reach 3.5 meters and a pickup angle of the electronic equipment is enlarged into 360°, i.e., all directions, so that a pickup capability of the electronic equipment is improved.

With respect to the device in the above aspect, the specific manners for performing operations for individual modules therein have been described in detail in the aspect regarding the method, which will not be elaborated herein.

An exemplary aspect of the present disclosure provides electronic equipment, which may implement an audio signal processing method provided by the present disclosure, the electronic equipment including: a processor and a memory arranged to store an instruction executable for the processor, wherein the processor is arranged to:

acquire an audio signal acquired by each audio acquisition device and determine a position of a target sound source sending the audio signal relative to multiple audio acquisition devices according to the audio signal acquired by each audio acquisition device;

determine a target signal optimization algorithm corresponding to the position of the target sound source relative to the multiple audio acquisition devices according to pre-stored correspondences between directions and signal optimization algorithms; and input the audio signal acquired by each audio acquisition device into the determined target signal optimization algorithm to obtain an optimized audio signal.

Figure 5:
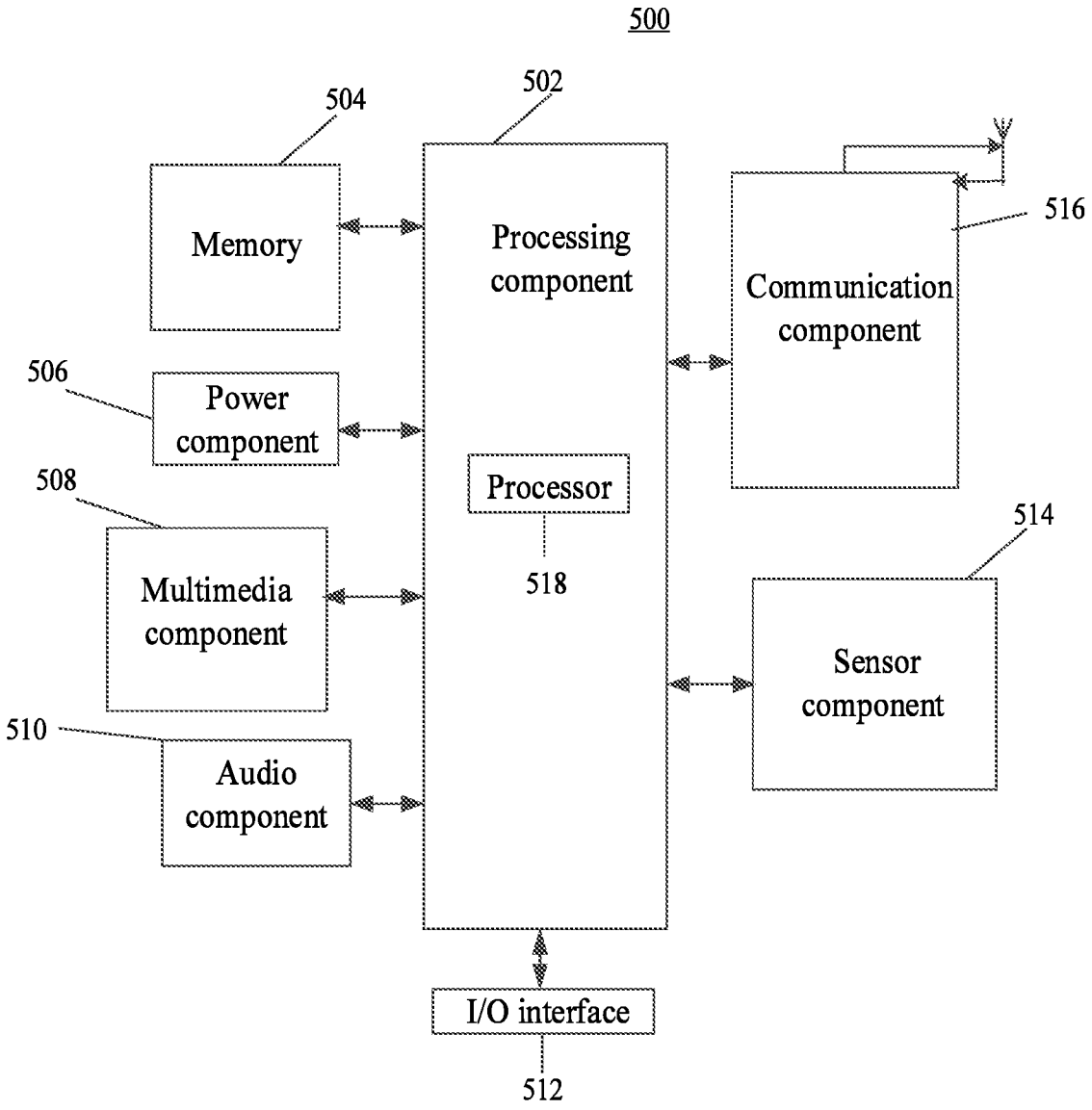
FIG. 5 is a block diagram of electronic equipment, according to an exemplary aspect of the present disclosure.

FIG. 5 is a block diagram of electronic equipment, according to an exemplary aspect. For example, the electronic equipment 500 may be a mobile phone, a computer, digital broadcast electronic equipment, a messaging device, a gaming console, a tablet, a medical device, exercise equipment, a personal digital assistant and the like.

Referring to FIG. 5, the electronic equipment 500 may include one or more of the following components: a processing component 502, a memory 504, a power component 506, a multimedia component 508, an audio component 510, an Input/Output (I/O) interface 512, a sensor component 514, and a communication component 516.

The processing component 502 typically controls overall operations of the electronic equipment 500, such as the operations associated with display, telephone calls, data communications, camera operations, and recording operations. The processing component 502 may include one or more processors 518 to execute instructions to perform all or part of the steps in the abovementioned method. Moreover, the processing component 502 may include one or more modules which facilitate interaction between the processing component 502 and the other components. For instance, the processing component 502 may include a multimedia module to facilitate interaction between the multimedia component 508 and the processing component 502.

The memory 504 is arranged to store various types of data to support the operation of the electronic equipment 500. Examples of such data include instructions for any application programs or methods operated on the electronic equipment 500, contact data, phonebook data, messages, pictures, video, etc. The memory 504 may be implemented by any type of volatile or non-volatile memory devices, or a combination thereof, such as a Static Random Access Memory (SRAM), an Electrically Erasable Programmable Read-Only Memory (EEPROM), an Erasable Programmable Read-Only Memory (EPROM), a Programmable Read-Only Memory (PROM), a Read-Only Memory (ROM), a magnetic memory, a flash memory, and a magnetic or optical disk.

The power component 506 provides power for various components of the electronic equipment 500. The power component 506 may include a power management system, one or more power supplies, and other components associated with generation, management and distribution of power for the electronic equipment 500.

The multimedia component 508 includes a screen providing an output interface between the electronic equipment 500 and a user. In some aspects, the screen may include a Liquid Crystal Display (LCD) and a Touch Panel (TP). If the screen includes the TP, the screen may be implemented as a touch screen to receive an input signal from the user. The TP includes one or more touch sensors to sense touches, swipes and gestures on the TP. The touch sensors may not only sense a boundary of a touch or swipe action but also detect a duration and pressure associated with the touch or swipe action. In some aspects, the multimedia component 508 includes a front camera and/or a rear camera. The front camera and/or the rear camera may receive external multimedia data when the electronic equipment 500 is in an operation mode, such as a photographing mode or a video mode. Each of the front camera and the rear camera may be a fixed optical lens system or have focusing and optical zooming capabilities.

The audio component 510 is arranged to output and/or input an audio signal. For example, the audio component 510 includes a Microphone (MIC), and the MIC is arranged to receive an external audio signal when the electronic equipment 500 is in the operation mode, such as a call mode, a recording mode and a voice recognition mode. The received audio signal may further be stored in the memory 504 or sent through the communication component 516. In some aspects, the audio component 510 further includes a speaker arranged to output the audio signal.

The I/O interface 512 provides an interface between the processing component 502 and a peripheral interface module, and the peripheral interface module may be a keyboard, a click wheel, a button and the like. The button may include, but not limited to: a home button, a volume button, a starting button and a locking button.

The sensor component 514 includes one or more sensors arranged to provide status assessment in various aspects for the electronic equipment 500. For instance, the sensor component 514 may detect an on/off status of the electronic equipment 500 and relative positioning of components, such as a display and small keyboard of the electronic equipment 500, and the sensor component 514 may further detect a change in a position of the electronic equipment 500 or a component of the electronic equipment 500, presence or absence of contact between the user and the electronic equipment 500, orientation or acceleration/deceleration of the electronic equipment 500 and a change in temperature of the electronic equipment 500. The sensor component 514 may include a proximity sensor arranged to detect presence of an object nearby without any physical contact. The sensor component 514 may also include a light sensor, such as a Complementary Metal Oxide Semiconductor (CMOS) or Charge Coupled Device (CCD) image sensor, configured for use in an imaging application. In some aspects, the sensor component 514 may also include an acceleration sensor, a gyroscope sensor, a magnetic sensor, a pressure sensor or a temperature sensor.

The communication component 516 is arranged to facilitate wired or wireless communication between the electronic equipment 500 and other equipment. The electronic equipment 500 may access a communication-standard-based wireless network, such as a Wireless Fidelity (WiFi) network, a 2nd-Generation (2G) or 3rd-Generation (3G) network or a combination thereof. In an exemplary aspect, the communication component 516 receives a broadcast signal or broadcast associated information from an external broadcast management system through a broadcast channel. In an exemplary aspect, the communication component 516 further includes a Near Field Communication (NFC) module to facilitate short-range communication. For example, the NFC module may be implemented on the basis of a Radio Frequency Identification (RFID) technology, an Infrared Data Association (IrDA) technology, an Ultra-WideBand (UWB) technology, a Bluetooth (BT) technology and another technology.

In an exemplary aspect, the electronic equipment 500 may be implemented by one or more Application Specific Integrated Circuits (ASICs), Digital Signal Processors (DSPs), Digital Signal Processing Devices (DSPDs), Programmable Logic Devices (PLDs), Field Programmable Gate Arrays (FPGAs), controllers, micro-controllers, microprocessors or other electronic components, and is arranged to execute the audio signal processing method provided by each of the abovementioned method aspects.

In an exemplary aspect, there is also provided a non-transitory computer-readable storage medium including an instruction, such as the memory 504 including an instruction, and the instruction may be executed by the processor 518 of the electronic equipment 500 to implement the abovementioned audio signal processing method. For example, the non-transitory computer-readable storage medium may be a ROM, a Random Access Memory (RAM), a Compact Disc Read-Only Memory (CD-ROM), a magnetic tape, a floppy disc, optical data storage equipment and the like.

According to a non-transitory computer-readable storage medium, when an instruction in the storage medium is executed by a processor of electronic equipment to enable the electronic equipment to execute an audio signal processing method, the method including that:

an audio signal acquired by each audio acquisition device is acquired, and a position of a target sound source sending the audio signal relative to multiple audio acquisition devices is determined according to the audio signal acquired by each audio acquisition device;

a target signal optimization algorithm corresponding to the position of the target sound source relative to multiple audio acquisition devices is determined according to pre-stored correspondences between directions and signal optimization algorithms; and the audio signal acquired by each audio acquisition device is input into the determined target signal optimization algorithm to obtain an optimized audio signal.

Optionally, the operation that the position of the target sound source sending the audio signal relative to the multiple audio acquisition devices is determined according to the audio signal acquired by each audio acquisition device includes that:

the audio signal acquired by each audio acquisition device is converted into a corresponding frequency-domain signal;

cross-correlation spectrum calculation is performed on each frequency-domain signal to obtain differences in acquisition time of respective audio signals by different audio acquisition devices; and the position of the target sound source sending the audio signal relative to the multiple audio acquisition devices is determined according to the differences in acquisition time of respective audio signals by different audio acquisition devices and distances between the multiple audio acquisition devices.

Optionally, the number of the audio acquisition devices is 2, a distance between the two audio acquisition devices is equal to a preset distance value, and the two audio acquisition devices are arranged on the same sidewall of the electronic equipment.

Optionally, the operation that the target signal optimization algorithm corresponding to the position of the target sound source relative to multiple audio acquisition devices is determined according to the pre-stored correspondences between the directions and the signal optimization algorithms includes that:

an included angle between a connecting line of the target sound source and a midpoint of the two audio acquisition devices and a target ray is determined, wherein the target ray is a ray perpendicular to the sidewall at the midpoint and pointing to an outer side of the sidewall; and a target signal optimization algorithm corresponding to the included angle between the connecting line and the target ray is determined according to pre-stored correspondences between included angles and signal optimization algorithms.

Optionally, the operation that the target signal optimization algorithm corresponding to the included angle between the connecting line and the target ray is determined according to the pre-stored correspondences between the included angles and the signal optimization algorithms includes that:

when the included angle is smaller than a preset threshold value, it is determined that the target signal optimization algorithm is a Chebyshev algorithm; and when the included angle is larger than the preset threshold value, it is determined that the target signal optimization algorithm is a differential array algorithm.

Optionally, orientations of the two audio acquisition devices are the same and both of them face the outer side of the sidewall.

In the aspect of the present disclosure, the sound source position of the target sound source is determined to obtain the signal optimization algorithm corresponding to the sound source direction. then signal optimization is performed on the audio signal of the target sound source. Since a terminal determines the signal optimization algorithm corresponding to the target sound source according to the sound source direction, it is possible to solve the problem of poor noise suppression effect caused by the fact that the electronic equipment adopts the same noise suppression manner for acquired audio signals in the conventional art, and an effect of improving the noise suppression effect is achieved.

In the aspect, when the distance between the two audio acquisition devices is 6 cm~7 cm and the two audio acquisition devices are arranged on the same sidewall of the electronic equipment, a pickup distance of the electronic equipment may reach 3.5 meters and a pickup angle of the electronic equipment is enlarged into 360°, i.e., all directions, so that a pickup capability of the electronic equipment is improved.

It is to be understood that, a singular form "one" ("a", "an" and "the") used in the present disclosure is also intended to include a plural form unless exceptional cases clearly supported in the context. It is also to be understood that "and/or" used in the present disclosure refers to inclusion of any or all possible combinations of one or more than one associated items which are listed.

It is noted that the various modules, sub-modules, units, and components in the present disclosure can be implemented using any suitable technology. For example, a module may be implemented using circuitry, such as an integrated circuit (IC). As another example, a module may be implemented as a processing circuit executing software instructions.

Other implementation solutions of the present disclosure will be apparent to those skilled in the art from consideration of the specification and practice of the present disclosure. This disclosure is intended to cover any variations, uses, or adaptations of the present disclosure following the general principles thereof and including such departures from the present disclosure as come within known or customary practice in the art. It is intended that the specification and examples be considered as exemplary only, with a true scope and spirit of the present disclosure being indicated by the following claims.

It will be appreciated that the present disclosure is not limited to the exact construction that has been described above and illustrated in the accompanying drawings, and that various modifications and changes may be made without departing from the scope thereof. It is intended that the scope of the present disclosure only be limited by the appended claims.

What is claimed is:

1. An audio signal processing method, applied to an electronic equipment that includes multiple audio acquisition devices with distances between the multiple audio acquisition devices meeting a preset distance condition, the method comprising:

acquiring an audio signal acquired by each of the audio acquisition devices;

determining a position of a target sound source sending the audio signal relative to the multiple audio acquisition devices based on the audio signal acquired by each of the audio acquisition devices;

determining a target signal optimization algorithm corresponding to the position of the target sound source relative to the multiple audio acquisition devices based on pre-stored correspondences between directions and signal optimization algorithms, wherein determining the target signal optimization algorithm comprises:

determining an included angle between a connecting line of the target sound source and a midpoint of two audio acquisition devices and a target ray, wherein the target ray is a ray perpendicular to a sidewall of the electronic equipment at the midpoint and pointing to an outer side of the sidewall; and determining the target signal optimization algorithm corresponding to the included angle between the connecting line and the target ray based on pre-stored correspondences between included angles and signal optimization algorithms, wherein determining the target signal optimization algorithm based on the pre-stored correspondences comprises:

when the included angle is less than a preset threshold value, determining that the target signal optimization algorithm is a Chebyshev algorithm; and when the included angle is greater than the preset threshold value, determining that the target signal optimization algorithm is a differential array algorithm;

inputting the audio signal acquired by each of the audio acquisition devices into the determined target signal optimization algorithm; and obtaining an optimized audio signal based on the determined target signal optimization algorithm.

2. The method of claim 1, wherein determining the position of the target sound source comprises:

converting the audio signal acquired by each of the audio acquisition devices into a corresponding frequency-domain signal;

performing cross-correlation spectrum calculation on each of the frequency-domain signals to obtain differences in acquisition time of respective audio signals by different audio acquisition devices; and determining the position of the target sound source sending the audio signal relative to the multiple audio acquisition devices based on the differences in acquisition time of respective audio signals by different audio acquisition devices and the distances between the multiple audio acquisition devices.

3. The method of claim 1, wherein the number of the audio acquisition devices is two, a distance between the two audio acquisition devices is equal to a preset distance value, and the two audio acquisition devices are arranged on the sidewall of the electronic equipment.

4. The method of claim 3, wherein both of the two audio acquisition devices face the outer side of the sidewall.

5. An audio signal processing device, applied to an electronic equipment that includes multiple audio acquisition devices with distances between the multiple audio acquisition devices meeting a preset distance condition, the device comprising:

a processor; and a memory configured to store instructions executable by the processor, wherein the processor is configured to:

acquire an audio signal acquired by each of the audio acquisition devices;

determine a position of a target sound source sending the audio signal relative to the multiple audio acquisition devices based on the audio signal acquired by each of the audio acquisition devices;

determine a target signal optimization algorithm corresponding to the position of the target sound source relative to the multiple audio acquisition devices based on pre-stored correspondences between directions and signal optimization algorithms, wherein when determining the target signal optimization algorithm, the processor is further configured to:

determine an included angle between a connecting line of the target sound source and a midpoint of two audio acquisition devices and a target ray, wherein the target ray is a ray perpendicular to a sidewall of the electronic equipment at the midpoint and pointing to an outer side of the sidewall; and determine the target signal optimization algorithm corresponding to the included angle between the connecting line and the target ray based on pre-stored correspondences between included angles and signal optimization algorithms, wherein when determining the target signal optimization algorithm based on the pre-stored correspondences, the processor is further configured to:

when the included angle is less than a preset threshold value, determine that the target signal optimization algorithm is a Chebyshev algorithm; and when the included angle is greater than the preset threshold value, determine that the target signal optimization algorithm is a differential array algorithm;

input the audio signal acquired by each of the audio acquisition devices into the determined target signal optimization algorithm; and obtain an optimized audio signal based on the determined target signal optimization algorithm.

6. The device of claim 5, wherein, when determining the position of the target sound source, the processor is further configured to:

convert the audio signal acquired by each of the audio acquisition devices into a corresponding frequency-domain signal;

perform cross-correlation spectrum calculation on each of the frequency-domain signals to obtain differences in acquisition time of respective audio signals by different audio acquisition devices; and determine the position of the target sound source sending the audio signal relative to the multiple audio acquisition devices based on the differences in acquisition time of respective audio signals by different audio acquisition devices and the distances between the multiple audio acquisition devices.

7. The device of claim 5, wherein the number of the audio acquisition devices is two, a distance between the two audio acquisition devices is equal to a preset distance value, and the two audio acquisition devices are arranged on the sidewall of the electronic equipment.

8. The device of claim 7, wherein both of the two audio acquisition devices face the outer side of the sidewall.

9. A non-transitory computer-readable storage medium having stored therein instructions that, when executed by one or more processors of an electronic equipment including multiple audio acquisition devices with distances between the multiple audio acquisition devices meeting a preset distance condition, cause the one or more processors to:

acquire an audio signal acquired by each of the audio acquisition devices;

determine a position of a target sound source sending the audio signal relative to the multiple audio acquisition devices based on the audio signal acquired by each of the audio acquisition devices;

determine a target signal optimization algorithm corresponding to the position of the target sound source relative to the multiple audio acquisition devices based on pre-stored correspondences between directions and signal optimization algorithms, wherein when determining the target signal optimization algorithm, the instructions further cause the one or more processors to:

determine an included angle between a connecting line of the target sound source and a midpoint of two audio acquisition devices and a target ray, wherein the target ray is a ray perpendicular to a sidewall of the electronic equipment at the midpoint and pointing to an outer side of the sidewall; and determine the target signal optimization algorithm corresponding to the included angle between the connecting line and the target ray based on pre-stored correspondences between included angles and signal optimization algorithms, wherein when determining the target signal optimization algorithm based on the pre-stored correspondences, the instructions further cause the one or more processors to:

when the included angle is less than a preset threshold value, determine that the target signal optimization algorithm is a Chebyshev algorithm; and when the included angle is greater than the preset threshold value, determine that the target signal optimization algorithm is a differential array algorithm;

input the audio signal acquired by each of the audio acquisition devices into the determined target signal optimization algorithm; and obtain an optimized audio signal based on the determined target signal optimization algorithm.

10. The non-transitory computer-readable storage medium of claim 9, wherein, when determining the position of the target sound source, the instructions further cause the one or more processors to:

convert the audio signal acquired by each of the audio acquisition devices into a corresponding frequency-domain signal;

perform cross-correlation spectrum calculation on each of the frequency-domain signals to obtain differences in acquisition time of respective audio signals by different audio acquisition devices; and determine the position of the target sound source sending the audio signal relative to the multiple audio acquisition devices based on the differences in acquisition time of respective audio signals by different audio acquisition devices and the distances between the multiple audio acquisition devices.

11. The non-transitory computer-readable storage medium of claim 9, wherein the number of the audio acquisition devices is two, a distance between the two audio acquisition devices is equal to a preset distance value, and the two audio acquisition devices are arranged on the same sidewall of the electronic equipment.

12. The non-transitory computer-readable storage medium of claim 11, wherein both of the two audio acquisition devices face the outer side of the sidewall.

* * * * *